United States Patent [19]

Miller

[11] Patent Number: 4,816,969

[45] Date of Patent: Mar. 28, 1989

[54] WALL-MOUNTED OVER-BED LIGHTING FIXTURE

[75] Inventor: David H. Miller, Walnut Creek, Calif.

[73] Assignee: Hospital Systems Inc., Oakland, Calif.

[21] Appl. No.: 149,473

[22] Filed: Feb. 5, 1988

[51] Int. Cl.[4] ..... A47B 23/06

[52] U.S. Cl. ..... 362/130; 362/801; 362/282; 362/287; 362/394

[58] Field of Search ..... 362/130, 147, 223, 224, 362/225, 217, 234, 244, 245, 260, 277, 282, 283, 319, 322, 285, 287, 801, 35, 455, 394, 269, 275; 128/23

[56] References Cited

U.S. PATENT DOCUMENTS

| | | | |
|---|---|---|---|
| 1,298,362 | 3/1919 | Lewry | 362/130 |
| 1,739,337 | 12/1929 | Von Canon et al. | 362/130 |
| 1,906,626 | 5/1933 | Kramer | 362/130 |
| 3,022,416 | 2/1962 | Roberts | 362/245 |
| 4,149,222 | 4/1979 | Linde | 362/394 |
| 4,680,684 | 7/1987 | Wolber | 362/130 |

FOREIGN PATENT DOCUMENTS

| | | | |
|---|---|---|---|
| 110770 | 12/1939 | Australia | 362/130 |
| 2395460 | 2/1979 | France | 362/225 |

*Primary Examiner*—Michael Koczo
*Assistant Examiner*—D. M. Cox
*Attorney, Agent, or Firm*—Julian Caplan

[57] ABSTRACT

The housing for the fixture is mounted on a wall over the patient's bed. The housing accommodates a first non-rotatable fixture which directs light from fluorescent tubes downward through a conventional flat prismatic lens. There is also a longitudinally extending lens mounted within the outline of the housing and rotatable by means of handles at either end so that light from a second set of fluorescent tubes may be adjusted to function as a reading lamp for the patient, as an examining light at different locations of the patient's body and as a room illumination source, the intensity of room illumination being adjustable. A safety switch is moved to "off" position when the housing is struck by an object such as an IV rod fixed to an adjustable bed to stop the motor which moves the bed.

11 Claims, 3 Drawing Sheets

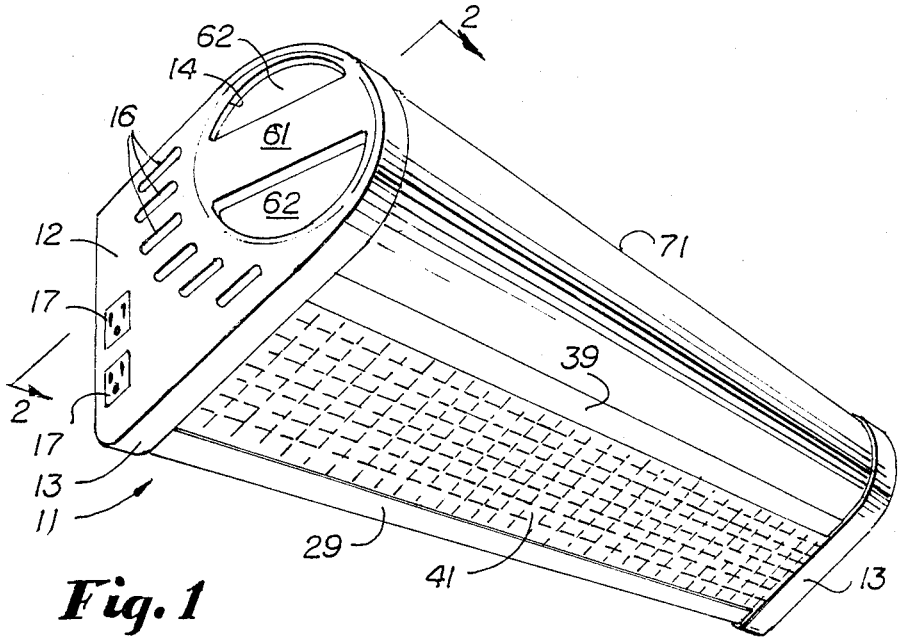
Fig. 1
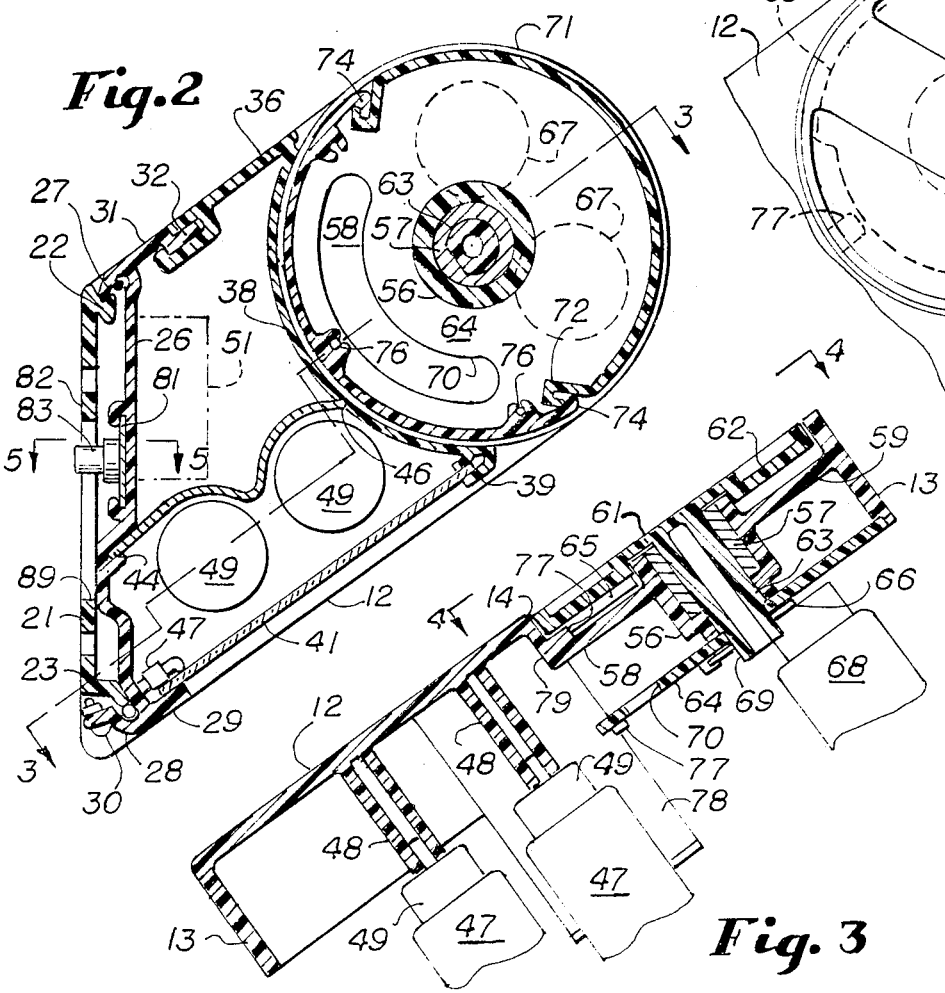
Fig. 2
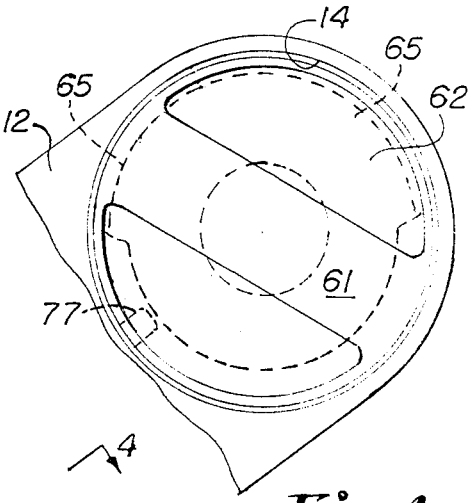
Fig. 4
Fig. 3

WALL-MOUNTED OVER-BED LIGHTING FIXTURE

BACKGROUND OF THE INVENTION

1. Field of the Invention

This invention relates to a wall-mounted over-bed hospital lighting fixture of the type which provides illumination of the head of the bed and is characterized by the provision of a rotatable lamp incorporated in the housing of the device which may be used as a patient reading lamp, as a physician's examining lamp and also as a variable room illumination lamp.

2. Description of Related Art

Wall-mounted bed lighting fixtures are well known in the art. Such fixtures generally have a horizontal flat prismatic lens through which illumination from the interior of the housing is directed to the head of the bed which is mounted immediately therebeneath. The provision of patient examining lights and reading lamps which are mounted on the wall is also well known.

The present invention differs from prior fixtures in that both lighting fixtures are totally enclosed within a wall-mounted housing.

U.S. Pat. No. 3,919,540 discloses a safety light with a switch responsive to interfering movement of an IV rod, or the like, which interrupts power to a bed-elevating motor. U.S. Pat. No. 4,149,222 shows a pivotal wall mounting for a bed light wherein the fixture is hinged to a mounting plate with a leaf hinge. The present invention provides an improved pivotal mounting which does not require a leaf hinge and is more easily installed than prior fixtures of this type. A room may be completely finished and painted before the fixture is set into place, preventing damage to the paint or to the fixture. The bracket then serves as an integral part of the safety interlock.

SUMMARY OF THE INVENTION

A single housing preferably formed of interfitting extrusions is provided which is mounted extending longitudinally horizontally on the wall above a bed and is used in hospitals, nursing homes and the like. On the bottom of the housing is a flat, horizontal, prismatic lens which directs illumination from one or more fluorescent tubes downward to illuminate the head of the bed.

Also mounted on the upper portion of the housing is a rotatable two-part cylinder, one part being transparent and the other opaque and within the cylinder are one or more additional fluorescent lamps. By turning a handle at either end of the housing, the cylindrical member may be directed in various positions. Thus, it may be directed to provide a patient reading lamp. It may also be adjusted so that it illuminates any portion of the bed and may be used by a physician or nurse as an examining lamp. Additionally, the transparent portion of the lamp may be directed toward the ceiling or any portion of the room to provide room illumination. Particularly in connection with the latter function, the amount of illumination may be controlled by exposing or concealing within the housing varying portions of the transparent part of the rotatable member.

The housing may also contain a night light which shines through louvers in the end cap of the housing.

Another feature of the invention is the fact that all of the rotatable elements including the handles which turn the rotatable member are at all times within the outline of the housing so that in none of its various positions of adjustment does the lamp extend outside the outline of the housing.

An advantage of the invention is the fact that, regardless of the position of adjustment of the rotatable lamp, it is always within the confines of the housing, thereby differing from those overhead reading lamps which are hinged or pivotted to the housing and in down position extend outside the housing.

Another advantage of the invention is that all wires for all lamps are contained within the housing and do not extend exteriorly thereof.

A still further feature of the invention is the provision of a safety interface comprising a switch which cuts off power to an adjustable bed or the like in the event that the bed or an upward-extending member attached to a bed comes in contact with the lighting fixture This safety feature prevents the hospital bed from being torn off the wall if it is wall-mounted and prevents damage to the housing of the fixture The mounting of the fixture to a plate attached to the wall is an improved feature of this invention.

FIGURES IN THE DRAWINGS

FIG. 1 is a perspective view of a fixture in accordance with the present invention.

FIG. 2 is a sectional view taken substantially along the line 2—2 of FIG. 1.

FIG. 3 is a sectional view taken substantially along the line 3—3 of FIG. 2.

FIG. 4 is a fragmentary enlarged end elevation as vised from the right of FIG. 3.

DESCRIPTION OF PREFERRED EMBODIMENT

Figure 6:
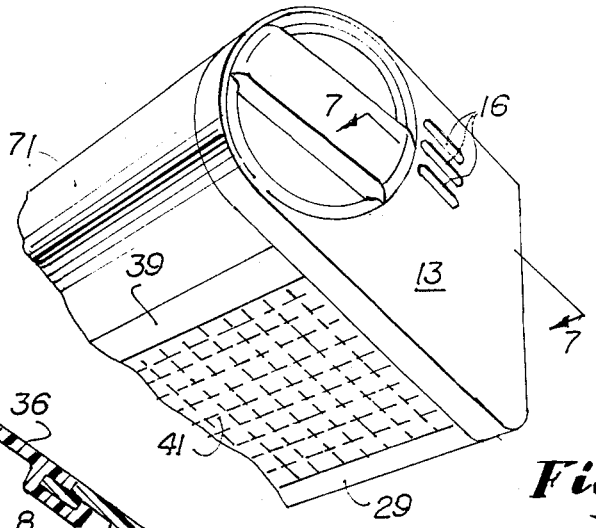
FIG. 6 is a perspective view of a portion of the device.
Figure 7:
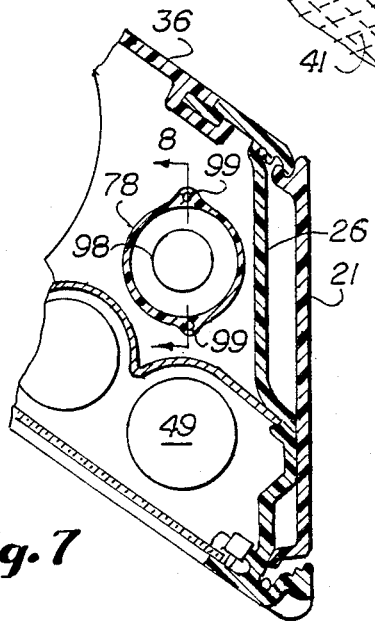
FIG. 7 is a fragmentary sectional view taken substantially along the line 7—7 of FIG. 6.
Figure 8:
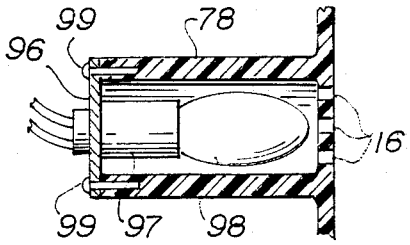
FIG. 8 is a sectional view along line 8—8 of FIG. 7.
Figure 5:
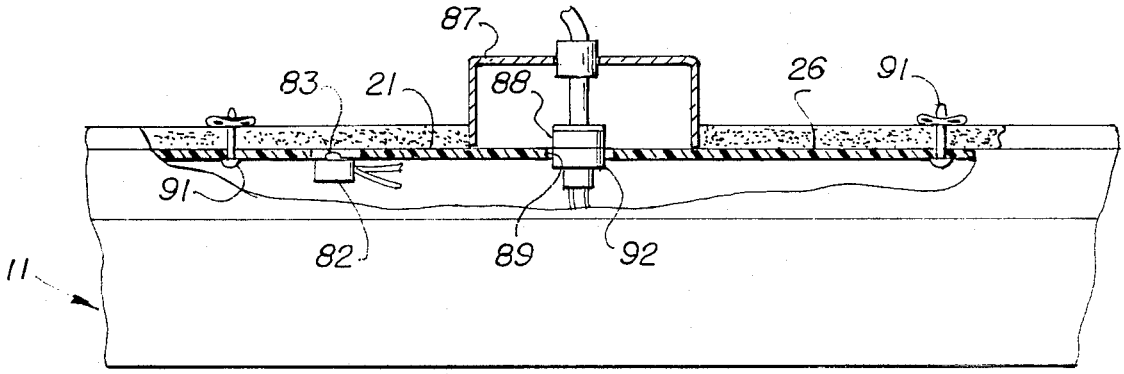
FIG. 5 is a fragmentary plan view showing the fixture mounted on a wall.

Housing 11 has end caps 12 at either end, each end cap 12 having an inward projecting relatively narrow rim 13. A circular hole 14 is formed in each end cap as are louvers 16. Sockets 17 may be recessed into the end caps for attachment of various appliances as desired.

Mounted within the housing 11 and within the confines of the end caps 12 is a longitudinally extending mounting bracket 21 which is fixed to a wall so that the housing 11 extends horizontally longitudinally above the bed. Wall 86 has a conventional junction box 87 recessed therein and extending outward therefrom is a first snap connector member 88. Bracket 21 has a knock-out hole 89 formed therein fitting over junction box 87. Bracket 21 is attached to wall 86 by screws 91. Along the top edge bracket 21 is a top interlock receptor 22 and along the bottom edge is a bottom interlock lug 23. Interfitting with bracket 21 is a longitudinally extending rear member 26 which has a top lug 27 received in receptor 22 and a bottom receptor 28 which receives bottom lug 23 in such manner that when an object such as an IV rod attached to a hospital bed strikes housing 11, rear member 21 pivots upward. Along the bottom of member 26 is an external flange 29 and along the top is a top flange 31 which is formed at its outer end with an internally offset lug 32. Screws 30 recessed in the lower part of the fixture are tightened to an extent to allow pivoting of top lug 27 on receptor 22 but still contain relative movement to prevent housing 11 from coming away from wall 86. Second snap connector member 92 mates with connector 88 when the members are assembled to supply power to the fixture.

Top member 36 has a top receptor 37 which receives lug 32 so that the members 31 and 26 comprise essentially a unit. Preferably top member 36 extends at an obtuse angle relative to member 21 and at its forward end is formed in an arcuate portion 38. The lower end of arcuate portion 38 comprises a bottom receptor 39. Mounted on the bottom of the housing is a flat prismatic lens 41 which is disposed approximately parallel to the top member 36. The upper end or outer edge of lens 41 is received in receptor 39 and its lower or inner edge is held by an edge clamp 42 connected to external flange 29 of rear member 26. The lens 41 may be removed by release of clamp 42. Above lens 41 is a reflector 43 the edges of which are received in receptors 44 and 46 in rear member 26 and arcuate portion 38, respectively. Fluorescent tubes 47 are held in place by inward extensions 4 end caps 12, the sockets 49 for the tubes 47 in threaded engagement with the hollow extensions 48. It will be understood that the shape of reflector 43 is such as to direct the illumination from the tubes 47 outward through the lens 41. Ballast 51 for tubes 47, shown schematically in FIG. 2, is mounted in the space above the reflectors 43. Various lengths of housing 11 may be used and the proper length tube 47 is chosen for a particular length housing.

Concentric with the center of curvature of arcuate portion 38 is a bearing hub 56 which is integral with end cap 12 and is connected to the end portion thereof by a web 58 and to the upper rim portion 13 thereof by web 59. Within the hub 56 is sleeve bearing 57. It will be noted that the webs 58 and 59 are recessed and fitting within the recess is a rotation handle or knob 61 formed with depressions 62 so that it may be conveniently gripped by a physician, nurse or other attendant to turn the handle 61. Fitting through sleeve bearing 57 is a hollow stem 63 which is an inward extension of handle 61. The inner end of stem 63 is formed non-circular with a flat 69 (see FIG. 4) and is received within an appropriate hole in mounting disk 64. A retaining ring 66 secures the stem 63 and disk 64 together. Attached to disk 64 are one or more sockets 67 to receive fluorescent tubes 68, preferably of the same length as tubes 47. A slot 70 here shown to be arcuate is formed in disk 64 for passage of wiring from the ballast 52 to the sockets 67. Ballast 52 is likewise within housing 11.

A transparent substantially semi-cylindrical rotatable lens 71 is provided having receptors 72 at either edge. Interfitting with lens 71 is a rotatable lens mounting 73 having at either edge lugs 74 which fit into the receptors 72. The members 71 and 73 comprise a cylindrical longitudinally extending member and attachment ears 76 are used to secure the mounting 73 to the disks 64. Arcuate portion 38, handle 61, stem 63, disk 64, lens 71, and lens mounting 73 all have a common center of curvature.

Stops 77 are inserted in wall 79 of opening 14 in cap 12. Handle 61 has a projection 65 which intersects stops 77 and limit the oscillatory movement of lens 71 to less than 360°.

One feature of the invention is the fact that the parts may largely be formed of aluminum alloy extrusions, thereby making the cost of construction relatively inexpensive.

A safety feature of the invention is the provision of a switch which may be opened if a hospital bed or the orthopedic frame above such a bed or an IV rod attached to the bed comes in contact with the fixture. Thus a mounting plate 81 is installed in a suitable socket in the rear member 26. A switch button 83 bears against the mounting bracket 21. If, due to distortion of the housing 11 by reason of contact with a bed or frame above a bed, the button 83 is pressed inward to open the circuit. Switch 82 may be used to discontinue power to the bed operating motor, to sound an alarm or for other purposes.

The fluorescent tubes 47 which provide illumination through the lens 41 illuminate the head of the bed in normal fashion. However, by rotating the handle 61, the transparent rotatable lens 71 may be adjusted in position so that it shines down to provide a reading lamp for the patient or may be turned so that it illuminates any portion of the patient's body for purpose of examination. The lens 71 may be turned upward so that indirect illumination of the room is provided and the degree of such illumination may be adjusted by the relative proportions of the transparent lens 71 and opaque mounting 73 which are exposed outside the arcuate portion 38.

For night-light purposes, a sub housing 78 is formed in end cap 12 adjacent louvers 16. A mounting plate 96 carries socket 97 for lamp 88. Plate 96 is attached to the inner open end of sub-housing 78 by screws 99. Light from lamp 98 shines out through louvers 16.

Figure 9:
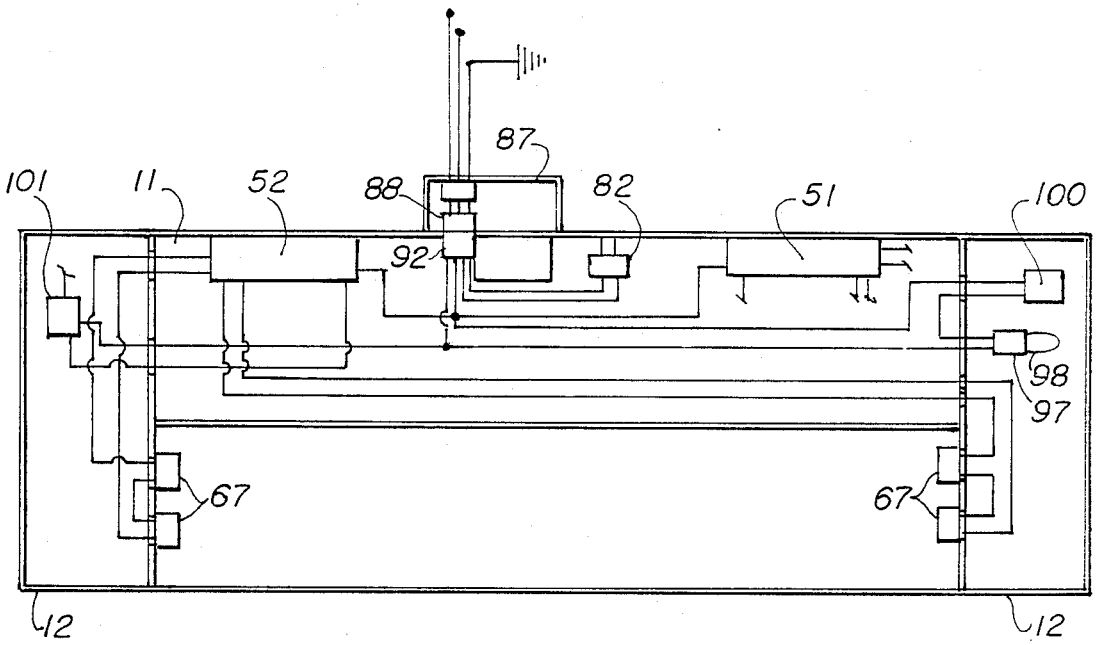
FIG. 9 is a schematic wiring layout of electrical portions of the invention.
Figure 10:
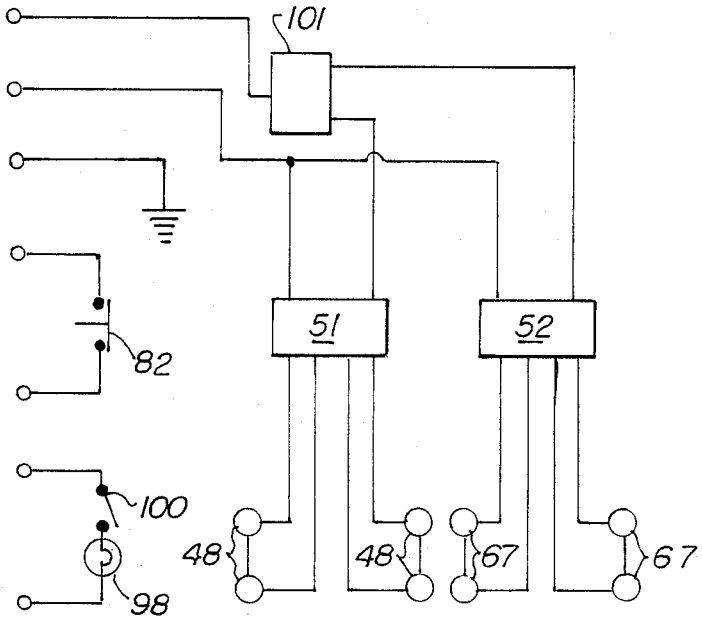
FIG. 10 is a schemtic wiring diagram of the same.

As previously stated, all wiring is confined within the housing 11. The wiring diagram for the fluorescent lamps 47 and 68 and for switch 82 is shown in FIG. 10. FIG. 9 shows schematically how the wiring and ballasts 51, 52 are disposed within the housing. A four-position switch 101 controls current entering the system from connector 92 to ballasts 51 and 52 for lamps 47 and 68, respectively, so that either set of lamps or both or neither may be illuminated by adjustment of switch 101, which is accessible from the exterior through an opening (not shown) in one of end caps 12. A toggle switch 100, also accessible from the exterior, controls night lamp 98.

What is claimed is:

1. An over-bed hospital lighting fixture comprising a longitudinally disposed housing having mounting means for mounting said housing on a wall, end caps on either end of said housing formed with aligned circular openings, a cylindrically arcuate member positioned in said housing outward of said mounting means and transverse to said end caps having its center of curvature substantially co-extensive with the center of curvature of said circular openings and disposed longitudinally of said housing, a substantially semi-cylindrical, substantially opaque lens mounting rotatable about an axis concentric with said center of curvature and having first connecting means along its longitudinal edges, a substantially semi-cylindrical, transparent lens with its axis substantially co-extensive with said center of curvature and having second connecting means along its longitudinal edges cooperable with said first connecting means to combine said lens mounting and said lens as a cylindrical unit, a pair of mounting disks connected adjacent either end of said housing for rotation with said cylindrical unit and having light sockets to receive light bulbs, a handle at at least one end of said housing having a shaft passing through said circular opening and connected for rotation with said lens mounting, said lens and said mounting disk, whereby by turning said handle the relative amount of light passing out of said housing through said lens may be adjusted.

2. A fixture according to claim 1 which further comprises a flat transparent bottom wall for said housing interposed between said mounting means and said arcuate member, a reflector inward of said bottom wall, lighting means between said reflector and said bottom wall and means for mounting said bottom wall, said reflector and said lighting means in said housing.

3. A fixture according to claim 2 in which said bottom wall comprises a substantially rectangular prismatic lens.

4. A fixture according to claim 3 in which said lighting means comprises longitudinally disposed fluorescent tubes.

5. A fixture according to claim 1 which further comprises a fluorescent tube longitudinally disposed in said housing having its opposite ends received in said sockets of said disks.

6. A fixture according to claim 1 in which each said end cap is formed with an indented annular web having a bearing housing concentric with said axis, said handle being recessed in said annular web, said handle having a stem passing through said web and connected inside said web to one said disk and to said lens mounting and said lens.

7. A fixture according to claim 1 which further comprises a rear member within said housing normally disposed substantially parallel to said mounting means, a safety limit switch carried by said rear member having a button resiliently biased outward toward a first position, said button being moved to a second position by said button engaging said mounting means when said rear member is disposed substantially parallel to said mounting means whereby force applied to said housing by an external object striking said housing causes said rear member to pivot outward away from said mounting means said button to move to first position, when said force is sufficient to damage said fixture or said external object.

8. A fixture according to claim 7 in which said mounting means is formed with a horizontal longitudinally extending interlock receptor along its top edge and said rear member is formed with a top lug fitting into said receptor so that said housing hangs from said receptor and may pivot upward relative to said mounting means.

9. A fixture according to claim 8 which further comprises adjustment screws in said housing engaging the bottom edge of said mounting means, said screws controlling the extent of pivotal movement of said rear member relative to said mounting means.

10. A fixture according to claim 8 in which said mounting means is formed with an opening for protrusion of a first electrical connector for power for said fixture, said housing having a second electrical connector mating with said first connector, whereby said fixture may be placed on a wall by first attaching said mounting means to said wall, then hanging said top lug on said receptor and engaging said first and second connectors and then pivoting said housing down so that said rear member is substantially flush with said mounting means.

11. A fixture according to claim 1 in which said arcuate member, opaque lens mounting, lens, and mounting disks are at all times confined within said housing regardless of the position of adjustment of said lens.

* * * * *